US005470528A

United States Patent [19]

Motomura et al.

[11] Patent Number: 5,470,528

[45] Date of Patent: Nov. 28, 1995

[54] LOW DECARBURIZATION SPRING STEEL

[75] Inventors: Hiroharu Motomura, Minamikawachi; Soichi Takasaki, Okegawa; Kenji Kinoshita, Kamagaya, all of Japan

[73] Assignee: Mitsubishi Steel Mfg. Co., Ltd., Tokyo, Japan

[21] Appl. No.: 281,240

[22] Filed: Jul. 27, 1994

[30] Foreign Application Priority Data

Apr. 4, 1994 [JP] Japan ..... 6-066016

[51] Int. Cl.$^6$ ..... C22C 38/60

[52] U.S. Cl. ..... 420/84; 148/908

[58] Field of Search ..... 148/908, 320; 420/84

[56] References Cited

FOREIGN PATENT DOCUMENTS 54-136518 10/1979 Japan .
59-177352 10/1984 Japan .
59-173250 10/1984 Japan ..... 420/84
61-183442 8/1986 Japan .
61-170542 8/1986 Japan .
1-319650 12/1989 Japan .
0973659 11/1982 U.S.S.R. ..... 420/84

*Primary Examiner*—Deborah Yee
*Attorney, Agent, or Firm*—Flynn, Thiel, Boutell & Tanis

[57] ABSTRACT

A low decarburization spring steel consisting essentially of, in weight percentages, 0.40 to 0.75% C, 0.15 to 2.50% Si, 0.30 to 1.20% Mn, 0.005 to 0.100% Al and 0.005 to 0.100% Se, and optionally at least one selected from the group consisting of 0.50 to 2.50% Ni, 0.20 to 1.50% Cr, 0.05 to 1.50% Mo and/or at least one selected from the group consisting of 0.01 to 0.50% V and 0.01 to 0.50% Nb, the balance being Fe and inevitable impurities. The spring steels of this invention considerably reduce decarburization during hot working or heat treatment without recourse to anti-decarburizing agents or special heat treatment equipment.

4 Claims, No Drawings

LOW DECARBURIZATION SPRING STEEL

BACKGROUND OF THE INVENTION

1. Field of the Invention

This invention relates to a spring steel which undergoes very little decarburization during hot working or heat treatment.

2. Description of the Prior Art

In general, flat springs, coil springs or torsion bars are manufactured by quenching and tempering hotrolled steel. If decarburization occurs during these manufacturing processes, however, the fatigue strength of the steel considerably deteriorates and it no longer has the properties required for a spring material. Conventionally, therefore, as described in Japanese Patent Application Laid-Open No. 54-136518, the steel has been subjected to heat treatment after forming a coating of an anti-decarburizing agent on the steel surface, or alternatively to controlled atmosphere heat treatment, etc., in order to prevent this decarburization from occurring.

Other methods of reducing decarburization consist in adding various elements to the steel. For example, these elements are V, Nb, Mo, W, Ta, Zr and Ti (Japanese Patent Application Laid-Open No. 59-177352); Cu and Ni (Japanese Patent Application Laid-Open No. 61-170542); As, Sn and Sb (Japanese Patent Application Laid-Open No. 61-183442); and Sb (Japanese Patent Application Laid-Open No. 1-319650).

The following conventional anti-decarburizing methods involve the following problems which inevitably lead to increased cost:

a: Forming a coating of an anti-decarburizing agent on the steel surface takes time, and requires special equipment.

b: Controlled atmosphere heat treatment requires extra cost, and the cost of running the heating furnace is also higher than in the conventional case.

SUMMARY OF THE INVENTION

An object of the present invention is to solve the above problems and provide a low cost spring steel with less tendency to undergo decarburization.

This invention provides a low decarburization spring steel consisting essentially of, in weight percentages, 0.40 to 0.75% C, 0.15 to 2.50% Si, 0.30 to 1.20% Mn, 0.005 to 0.100% Al and 0.005 to 0.100% Se, and optionally at least one selected from the group consisting of 0.50 to 2.50% Ni, 0.20 to 1.50% Cr, 0.05 to 1.50% Mo and/or at least one selected from the group consisting of 0.01 to 0.50% V and 0.01 to 0.50% Nb, the balance being Fe and inevitable impurities.

Throughout the specification, all percentages specified are by weight unless otherwise indicated.

DETAILED DESCRIPTION OF THE PREFERRED EMBODIMENTS

The Inventors, as a result of detailed studies carried out in order to improve decarburization properties during hot working or heat treatment of spring steel having C, Si, Mn as its principal addition components, discovered that Se and various other elements, as specified above, were effective in achieving this goal, and thereby arrived at the present invention.

The reasons for the limits of each of these elements are as follows.

C: C is effective for increasing the strength of the steel. However, if its proportion is less than 0.40%, the strength required as a spring is not obtained, while if its proportion exceeds 0.75%, the spring is too brittle. The proportion is therefore set to within the range of 0.40 to 0.75%.

Si: Si acts as a deoxidizing agent in the manufacture of steel ingots and it is effective for improving the strength of the steel by dissolving as a solid solution into ferrite. However, if its proportion is less than 0.15%, the deoxidizing action is insufficient and the strength required as a spring is not obtained, while if its proportion exceeds 2.50%, the toughness of the steel deteriorates. The proportion is therefore set to be within the range of 0.15 to 2.50%.

Mn: Mn is effective in improving the hardenability of the steel. For this purpose, its proportion must be no less than 0.30%, however if its proportion exceeds 1.20%, the toughness of the steel deteriorates. The proportion is therefore set to within the range of 0.30 to .20%.

Al: Al is a deoxidizing agent, and it is also necessary for adjusting the crystal particle size of austenite. However, if its proportion is less than 0.005%, fine crystal particles cannot be formed, while if its proportion exceeds 0.100%, the casting properties of the steel are easily impaired. The proportion is therefore set to be within the range 0.005 to 0.100%.

Se: Se exists in steel in the form of MnSe. It is effective in removing decarburized layers through the formation of scale during heating, and is therefore effective for preventing decarburization. In order to obtain this effect, its proportion must be no less than 0.005%, however if its proportion exceeds 0.100%, the toughness of the steel deteriorates. The proportion is therefore set to be within the range of 0.005 to 0.100%, the most preferred range being 0.01 to 0.05%.

Ni: Ni is effective for improving the hardenability of the steel. However, if its proportion is less than 0.50%, this effect is insufficient, while if its proportion exceeds 2.50%, the retained austenite in the spring after quenching and tempering increases which has an adverse effect on spring fatigue strength. The proportion is therefore set to be within the range of 0.50 to 2.50%.

Cr: Cr is effective for increasing the strength of the steel. However, if its proportion is less than 0.20%, this effect is insufficient, while if its proportion exceeds 1.50%, the toughness of the steel deteriorates. The proportion is therefore set to be within the range of 0.20 to 1.50%.

Mo: Mo maintains the hardenability of the steel, and increases the strength and toughness of the steel. However, if its proportion is less than 0.05%, these effects are insufficient, while if its proportion exceeds 1.50%, coarse carbides tend to precipitate so that spring properties deteriorate. The proportion is therefore set to be within tile range of 0.05 to 1.50%.

V: V increases the strength of the steel. However, if its proportion is less than 0.01%, this effect is insufficient, while if its proportion exceeds 0.50%, carbides which are insoluble in austenite increase so that spring properties deteriorate. The proportion is therefore set to be within the range of 0.01 to 0.50%.

Nb: Nb increases the strength and toughness of the steel due to refinement of crystal grains and precipitation of refined carbides. However, if the proportion is less than 0.01%, this effect is insufficient, while if the proportion exceeds 0.50%, carbides which are insoluble in austenite increase so that spring properties deteriorate. The proportion is therefore set to be within the range of 0.01 to 0.50%.

This invention relates to the low decarburization spring steel having the aforesaid essential components and, further, optional components. This spring steel may however be obtained also through ordinary steel-making, ingot-making or continuous casting, blooming, bar rolling, wire rod rolling, or flat steel rolling.

EXAMPLES

Table 1 shows steel compositions according to Examples of this invention and Comparative Examples.

TABLE 1

| No. | C | Si | Mn | Al | Se | Ni | Cr | Mo | V | Nb | Fe |
|---|---|---|---|---|---|---|---|---|---|---|---|
| 1 | 0.60 | 2.01 | 0.83 | 0.023 | 0.05 | (0.04) | (0.13) | (0.02) | — | — | bal. |
| 2 | 0.55 | 0.24 | 0.86 | 0.032 | 0.03 | (0.02) | 0.81 | (0.02) | — | — | bal. |
| 3 | 0.55 | 1.46 | 0.72 | 0.027 | 0.02 | (0.02) | 0.75 | (0.01) | — | — | bal. |
| 4 | 0.62 | 2.07 | 0.91 | 0.027 | 0.04 | (0.03) | 0.10) | (0.01) | — | 0.049 | bal. |
| 5 | 0.59 | 1.96 | 0.88 | 0.024 | 0.02 | (0.03) | (0.08) | (0.02) | 0.19 | — | bal. |
| 6 | 0.53 | 0.27 | 0.87 | 0.021 | 0.07 | (0.07) | 0.97 | (0.02) | 0.15 | — | bal. |
| 7 | 0.58 | 0.28 | 0.81 | 0.028 | 0.02 | (0.03) | 0.79 | 0.29 | — | — | bal. |
| 8 | 0.54 | 1.48 | 0.76 | 0.029 | 0.03 | (0.02) | 0.81 | (0.01) | 0.16 | 0.031 | bal. |
| 9 | 0.52 | 0.25 | 0.83 | 0.030 | 0.005 | (0.02) | 0.95 | (0.02) | 0.20 | 0.040 | bal. |
| 10 | 0.53 | 0.26 | 0.90 | 0.038 | 0.04 | (0.05) | 1.04 | (0.01) | 0.19 | 0.046 | bal. |
| 11 | 0.59 | 0.25 | 0.84 | 0.026 | 0.10 | (0.03) | 0.83 | (0.02) | 0.16 | 0.030 | bal. |
| 12 | 0.51 | 1.53 | 0.47 | 0.023 | 0.01 | (0.09) | 0.73 | 0.10 | 0.15 | 0.027 | bal. |
| 13 | 0.50 | 1.48 | 0.66 | 0.033 | 0.04 | 1.59 | 0.97 | 0.79 | 0.10 | 0.026 | bal. |
| 14 | 0.62 | 2.05 | 0.82 | 0.027 | — | 0.06 | 0.15 | 0.01 | — | — | bal. |
| 15 | 0.61 | 1.98 | 0.87 | 0.025 | — | 0.03 | 0.11 | 0.01 | — | 0.045 | bal. |
| 16 | 0.59 | 2.03 | 0.89 | 0.028 | — | 0.04 | 0.10 | 0.02 | 0.16 | — | bal. |
| 17 | 0.56 | 0.25 | 0.80 | 0.030 | — | 0.02 | 0.80 | 0.01 | — | — | bal. |
| 18 | 0.52 | 0.29 | 0.83 | 0.027 | — | 0.06 | 0.95 | 0.02 | 0.15 | — | bal. |
| 19 | 0.51 | 0.24 | 0.88 | 0.029 | — | 0.03 | 0.93 | 0.01 | 0.20 | 0.038 | bal. |
| 20 | 0.55 | 1.43 | 0.76 | 0.022 | — | 0.06 | 0.78 | 0.01 | — | — | bal. |
| 21 | 0.56 | 1.47 | 0.83 | 0.031 | — | 0.03 | 0.76 | 0.01 | 0.17 | — | bal. |
| 22 | 0.53 | 1.48 | 0.46 | 0.027 | — | 0.09 | 0.74 | 0.10 | 0.14 | 0.023 | bal. |
| 23 | 0.51 | 1.56 | 0.65 | 0.043 | — | 1.63 | 0.99 | 0.69 | 0.11 | 0.024 | bal. |

Remark:
Figures in brackets in the examples represent the amounts of inevitable impurities.
Nos. 1–13 : Examples of the Invention
Nos. 14–23: Comparative Examples Table 2 shows the ferrite decarburized depth and the total decarburized depth when the specimen steels shown in Table 1 were maintained at 900° C. for 30 min, quench hardened and tempered at 455° C. for 1 hour. Whereas ferrite decarburization occurs in the steels of Comparative Examples, there is no ferrite decarburization in the steels of Examples of the present invention. Moreover, the total decarburized depth is less in the case of the steels in the Examples of the invention than in the steels of the Comparative Examples. This shows that the steels of this invention comprising the components controlled within the compositional range defined in the appended claims, particularly with the addition of Se, are extremely effective in preventing ferrite decarburization and reducing the total decarburized depth. No deterioration of spring properties which could be ascribed to the addition of Se was observed.

TABLE 2

| No | Ferrite-decarburized depth (mm) | Total decarburized depth (mm) |
|---|---|---|
| 1 | 0 | 0.02 |
| 2 | 0 | 0.00 |
| 3 | 0 | 0.02 |
| 4 | 0 | 0.03 |

TABLE 2-continued

| No | Ferrite-decarburized depth (mm) | Total decarburized depth (mm) |
|---|---|---|
| 5 | 0 | 0.03 |
| 6 | 0 | 0.00 |
| 7 | 0 | 0.00 |
| 8 | 0 | 0.03 |
| 9 | 0 | 0.00 |
| 10 | 0 | 0.00 |
| 11 | 0 | 0.00 |

TABLE 2-continued

| No | Ferrite-decarburized depth (mm) | Total decarburized depth (mm) |
|---|---|---|
| 12 | 0 | 0.02 |
| 13 | 0 | 0.01 |
| 14 | 0.04 | 0.09 |
| 15 | 0.05 | 0.10 |
| 16 | 0.06 | 0.11 |
| 17 | 0.01 | 0.03 |
| 18 | 0.02 | 0.05 |
| 19 | 0.02 | 0.06 |
| 20 | 0.03 | 0.08 |
| 21 | 0.04 | 0.08 |
| 22 | 0.04 | 0.09 |
| 23 | 0.02 | 0.04 |

Remark:
Nos. 1–13 Examples of the Invention
Nos. 14–23: Comparative Examples

The spring steels of this invention considerably reduce decarburization during hot working or heat treatment without recourse to anti-decarburizing agents or special heat treatment equipment. They therefore have the excellent advantage of largely suppressing decarburization at low cost when applied to the manufacture of coil springs, flat springs or torsion bars.

What is claimed is:

1. A low decarburization spring steel consisting essentially of, in weight percentages, 0.40 to 0.75% C, 0.15 to 2.50% Si, 0.30 to 1.20% Mn, 0.005 to 0.100% Al, 0.02 to 0.100% Se and the balance consisting of Fe and inevitable impurities.

2. A low decarburization spring steel consisting essentially of, in weight percentage, 0.40 to 0.75% C, 0.15 to 2.50% Si, 0.30 to 1.20% Mn, 0.005 to 0.100% Al, 0.02 to 0.100% Se, at least one selected from the group consisting of 0.50 to 2.50% Ni, 0.20 to 1.50% Cr, 0.05 to 1.50% Mo and/or at least one selected from the group consisting of 0.01 to 0.50% V and 0.01 to 0.50% Nb, and the balance consisting of Fe and inevitable impurities.

3. A low decarburization spring steel as defined in claim 1 in which said Se is in the range of 0.02 to 0.05% by weight.

4. A low decarburization spring steel as defined in claim 2 in which said Se is in the range of 0.02 to 0.05% by weight.

* * * * *